US005275892A

United States Patent [19]

Hyner et al.

[11] Patent Number: 5,275,892

[45] Date of Patent: * Jan. 4, 1994

[54] MULTI-LAYER CORROSION RESISTANT COATING FOR FASTENERS AND METHOD OF MAKING

[75] Inventors: Jacob Hyner, Waterbury; Barbara S. Lewis, Naugatuck, both of Conn.

[73] Assignee: Whyco Chromium Company, Inc., Thomaston, Conn.

[ * ] Notice: The portion of the term of this patent subsequent to Dec. 4, 2007 has been disclaimed.

[21] Appl. No.: 858,567

[22] Filed: Mar. 27, 1992

Related U.S. Application Data

[63] Continuation-in-part of Ser. No. 617,625, Nov. 26, 1990, abandoned, which is a continuation-in-part of Ser. No. 349,228, May 9, 1989, Pat. No. 4,975,337, which is a continuation-in-part of Ser. No. 192,480, May 11, 1988, Pat. No. 4,837,090, which is a continuation-in-part of Ser. No. 117,794, Nov. 5, 1987, Pat. No. 4,746,408.

[51] Int. Cl.[5] ..... B32B 15/18; C25D 5/10

[52] U.S. Cl. ..... 428/648; 205/176; 205/177; 411/902; 427/406; 428/658; 428/667; 428/674; 428/675; 428/679; 428/935

[58] Field of Search ..... 205/176, 177; 428/648, 428/658, 659, 667, 674, 675, 679, 935; 427/405, 406; 411/902

[56] References Cited

U.S. PATENT DOCUMENTS

| | | | |
|---|---|---|---|
| 1,564,581 | 5/1924 | King . | |
| 2,419,231 | 12/1940 | Schantz | 29/191.4 |
| 2,989,446 | 6/1961 | Hammond et al. | 204/41 |
| 3,420,754 | 1/1969 | Roehl | 204/28 |
| 4,188,459 | 2/1980 | Hyner et al. | 428/648 |
| 4,282,073 | 8/1981 | Hirt et al. | 204/28 |
| 4,314,893 | 2/1982 | Clauss | 204/40 |
| 4,329,402 | 5/1982 | Hyner et al. | 428/621 |
| 4,407,900 | 10/1983 | Kirihara et al. | 428/659 |
| 4,500,610 | 2/1985 | Gunn et al. | 428/624 |
| 4,508,600 | 4/1985 | Irie et al. | 204/27 |
| 4,591,416 | 5/1986 | Kamitani et al. | 204/35.1 |
| 4,746,408 | 5/1988 | Hyner et al. | 204/40 |
| 4,837,090 | 6/1989 | Hyner et al. | 428/626 |
| 4,975,337 | 12/1990 | Hyner et al. | 428/648 |

FOREIGN PATENT DOCUMENTS

| | | |
|---|---|---|
| 57-207199 | 6/1981 | Japan . |
| 811750 | 7/1983 | PCT Int'l Appl. . |

OTHER PUBLICATIONS

F. A. Lowenheim, *Electroplating*, McGraw-Hill Book Company, New York, pp. 147-151 and 442-449, 1978.

H. Silman et al., *Protective and Decorative Coatings for Metals*, Finishing Publications Ltd. England, 1978, pp. 4-8 and 331.

*Primary Examiner*—John Niebling
*Assistant Examiner*—William T. Leader
*Attorney, Agent, or Firm*—DeLIO & Peterson

[57] ABSTRACT

A corrosion resistant coating and process comprises the following layers applied in sequence over a ferrous metal substrate: a micro-throwing nickel-zinc alloy plating; a zinc-nickel alloy plating containing 5 to 30 weight percent nickel; a galvanically protective zinc metal plating; and either copper, nickel and chromium (or chromium substitute) plating layers or a chromate conversion layer. The coating is preferably used with a steel fastener such as a bolt or drill screw in combination with a washer.

18 Claims, 2 Drawing Sheets

MULTI-LAYER CORROSION RESISTANT COATING FOR FASTENERS AND METHOD OF MAKING

BACKGROUND OF THE INVENTION

This application is a continuation-in-part of Ser. No. 617,625, filed Nov. 26, 1990, now abandoned, which is a continuation-in-part of Ser. No. 349,228, filed May 9, 1989 issued on Dec. 4, 1990 as U.S. Pat. No. 4,975,337 which is a continuation-in-part of Ser. No. 192,480, filed Sep. 11, 1988 issued on Jun. 6, 1989 as U.S. Pat. No. 4,837,090, which is a continuation-in-part of Ser. No. 117,794 filed Nov. 5, 1987 issued on May 24, 1988 as U.S. Pat. No. 4,746,408.

The present invention relates to multi-layered coatings to impart corrosion resistance to ferrous metal fastener substrates.

In areas where corrosion of ferrous metal substrates provide particular and pervasive problems, it is well known to utilize organic films such as paints and metallic coatings such as metal plating to minimize the effects of corrosion. Prior art in the general area of ferrous metal plating discloses nickel plating over an intermediate nickel zinc alloy plating (75 to 90% zinc), as in U.S. Pat. No. 1,564,581, and the use of zinc-rich, zinc-nickel alloy plating over a layer of copper or nickel plating, as in U.S. Pat. No. 2,419,231. Other uses of zinc-nickel plating layers are found in U.S. Pat. Nos. 4,282,073; 3,420,754; and 4,407,900; and in Japanese Patent Publication 57-207199. Zinc-nickel layers have also been plated directly onto iron or steel substrates to serve as a base for flash coatings of zinc and chromate films, as disclosed in U.S. Pat. Nos. 4,314,893 and 4,591,416.

In automotive and other applications where relatively severe corrosive agents are found, and, in particular, for the metal fasteners used in such applications, improvements in corrosion resistance have been disclosed in U.S. Pat. Nos. 4,188,459 and 4,329,402, the disclosures of which are hereby incorporated by reference. Prior to the aforementioned patents, it was known that automotive fasteners can utilize sequential plating layers of copper, cadmium, copper, nickel and chromium or a chromium substitute such as tin-nickel, tin-cobalt or tin-cobalt-zinc alloys.

U.S. Pat. No. 4,188,459 discloses a multi-layered corrosion resistant plating for fasteners comprising a first micro-throwing alloy layer of nickel alloy followed by a layer of a galvanically protective metal or alloy such as cadmium, cadmium-tin, a dual layer of cadmium and tin, zinc or zinc alloy. Over this galvanically protective layer there is applied a layer of copper plating, followed by a layer of nickel plating, followed by a layer of chromium or metallic chromium substitute. U.S. Pat. No. 4,329,402 discloses the same first layer of a micro-throwing alloy, with the galvanically protective plating layer optionally applied next, and followed by an outer layer of chromate film or an organic coating such as paint.

While the aforementioned plating and coating layers provide good protection, it is advantageous to provide comparable or superior protection with a minimum of coating layers, for obvious cost reasons. While the galvanic protective layers of zinc are desirable, when they are utilized as the final plating layer there is often the problem of the production of an insoluble white corrosion product as they are sacrificially attacked by corrosive agents in use.

In the area of automotive fasteners where the fasteners are often applied manually on the assembly line there is additional problems of fatigue of the assembly worker due to the often high installation torques, and long drill times resulting from the use of high friction and thicker corrosion resistant coatings. Cadmium plating has provided lower friction to ferrous fasteners, but such plating has considerable drawbacks with respect to disposal of plating bath effluent containing cadmium metal and the cyanide often used in such baths, as well as the presence of poisonous metallic cadmium on the fastener.

Bearing in mind these and other deficiencies of the prior art, it is therefore an object of the present invention to provide superior corrosion resistant to ferrous metal substrates which are used in relatively severe corrosive environments such as those found in the automobile.

It is another object of the present invention to provide a corrosion resistant coating which is relatively low in cost yet is reliable in application and performance.

It is a further object of the present invention to provide a superior corrosion resisting protection for metal substrates having surface defects such as pits, cracks, laps, or voids.

It is another object of the present invention to provide the aforementioned corrosion resistant properties for ferrous metal fasteners, in particular.

It is a further object of the present invention to provide improved plating for fasteners in automotive applications without the use of cadmium.

It is yet another object of the present invention to provide ferrous metal fasteners meeting the aforementioned objects which can be easily and readily manufactured.

SUMMARY OF THE INVENTION

The above and other objects, which will be obvious to one skilled in the art, are achieved in the present invention which provides, in a first aspect, a process for improving the corrosion resistance of a ferrous substrate such as a metal fastener comprising the steps of applying a layer of nickel or a nickel based alloy over the metal fastener and thereafter applying a second layer of a zinc based alloy over the nickel or nickel alloy layer. A layer of zinc plating, being preferably essentially pure zinc, is then applied to the zinc alloy, followed by plating of either copper, nickel and chromium (or chromium substitute) layers or a chromate conversion film layer. In another aspect, the present invention relates to a ferrous metal fastener having a corrosion resisting multi-layer coating applied as described above, each layer being applied directly to the previous layer. In both aspects of the invention it is preferred that the first layer be a micro-throwing nickel alloy with the second plating layer being a zinc-nickel alloy having from about 5 to about 30 weight percent nickel, more preferably from about 5 to about 15 weight percent nickel.

DETAILED DESCRIPTION OF THE INVENTION

Figure 1:
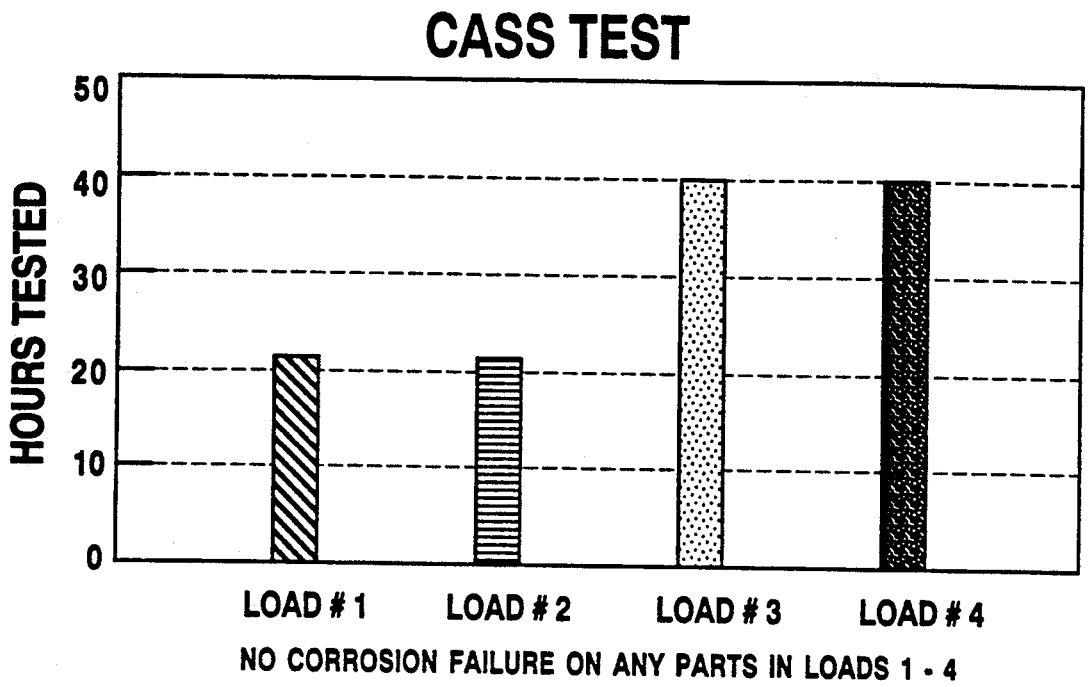
FIGS. 1-4 are graphical representations of the results of various corrosion tests performed on the embodiments of the present invention utilizing intermediate plating layers of zinc-nickel and zinc in conjunction with final plating layers of copper, nickel and chromium.

The multiple coating layers of the present invention can be applied to any ferrous metal substrate, e.g., iron or steel, and are particularly advantageous when applied to fasteners such as washers, bolts, rivets or drill screws or other metal cutting screws subject to relatively severe corrosive environments. Fasteners used on automobile or truck exteriors fall into this category, and include bolts or drill screws which incorporate a freely turning, non-removable washer adjacent to the head. Examples of drill screw fasteners are disclosed in U.S. Pat. Nos. 4,692,080; 4,730,970 and 4,713,855, the disclosures of which are hereby incorporated by reference.

Each layer of the multi-layer plating of the invention may be applied in any conventional manner, utilizing any conventional bath or method for application of the metal or alloy, for example, the baths and methods disclosed in U.S. Pat. No. 4,188,459, the disclosure of which is hereby incorporated by reference.

The first layer applied to and directly over the ferrous metal fastener substrate is a plating of nickel or nickel based alloy such as nickel-zinc, nickel-iron or nickel-cobalt. The preferred first layer is a micro-throwing nickel alloy as described in U.S. Pat. Nos. 4,188,459 and 4,329,402. The micro-throwing alloy is particularly advantageous in that it has the ability to preferentially plate in surface defects of metal substrates such as pits, cracks, laps, or voids as small as 0.00002 inches in size. The micro-throwing alloy deposits and forms a layer which is even thicker inside of the surface defects, seams, pits or the like than on the plane surface from which the surface defect is formed.

The micro-throwing nickel alloy preferably utilizes a second, alloying metal component selected from zinc, iron, cobalt or cadmium. Preferably, the nickel comprises about 97.0 to 99.9% by weight of the alloy, while the zinc or cadmium comprises 0.1 to 3.0 percent by weight. Most preferably, zinc is employed as the alloying agent in an amount less than 1.0% by weight of the alloy, with the nickel comprising the balance. Ternary or quaternary alloy containing nickel and zinc may also be advantageously utilized. The thickness of the first micro-throwing alloy layer is preferably between 0.0005 and 0.00005 inches, more preferably over 0.0001 and up to 0.0004 inches. This layer is not generally considered to be a so-called "strike" layer but is meant to level irregularities on the fastener surface and provide corrosion protection on its own.

The micro-throwing nickel alloy may be applied by conventional electroplating baths and techniques. For example, nickel-cadmium alloys can be electroplated from sulfate or sulfate-chloride type baths as are conventionally known and commercially available. Likewise, nickel-zinc alloys can be plated from chloride, sulfate, sulfamate, ammoniacial or pyrophosphate type baths.

Although the protection given the underlying metal by the prior art practice of depositing an essentially pure zinc galvanic layer is desirable, the corrosion product formed by oxidation of this galvanic layer is not. From both a functional and aesthetic view point, it is advantageous to minimize the formation of this corrosion product which, in the case of zinc, is white, insoluble and may comprise zinc carbonate ($Zn_2CO_3$), zinc oxide (ZnO) and other compounds. To retain the advantages of this galvanic layer while minimizing its disadvantages, the present invention provides in combination a separate layer of a zinc based alloy which is applied directly onto the first nickel or nickel alloy layer. This separate zinc alloy contains a major amount of zinc but does not as readily form the white corrosion product which results from essentially pure zinc. Additionally, it provides increased life to the ferrous part. Consequently, this zinc alloy layer provides a better appearance and gives additional protection when used over ferrous metal substrates. Suitable alloying elements are nickel, cobalt and iron, with nickel being preferred. The zinc-nickel alloy should contain a major amount of zinc and is preferably from about 70 to 95 weight percent zinc and from about 5 to 30 weight percent nickel, more preferably about 5 to 15 weight percent nickel, balance zinc. Good results have been achieved with 8 to 15 weight percent nickel, e.g., 12% nickel, although the most preferable range has been found to be 5 to 10 weight percent nickel, balance zinc.

The zinc-nickel alloy layer is preferably deposited by electroplating directly over the aforementioned layers by conventional and well-known techniques. The thickness of the zinc-nickel alloy layer is preferably about 0.00005 to 0.0007 inches, with a minimum thickness of 0.0001 inches being more preferred, and a minimum thickness of 0.0003 inches being most preferred. Best results have been found at a thickness of 0.00045 or $0.00040 \pm 0.0002$ in. where the zinc-nickel alloy layer is deposited directly onto the nickel or nickel alloy layer.

To provide some additional measure of protection for the underlying plating layers and metal substrate, but primarily to provide a suitable base for subsequent layers of either a chromate film conversion layer or layers of copper, nickel and chromium or a chromium substitute, a layer of zinc plating is preferably applied to and directly over the zinc based alloy layer. The property of the micro-throwing alloy first layer to level out or fill any surface defects in the underlying metal substrate acts to remove areas of low current density which provide problems when electroplating this zinc plating layer. The preferential zinc layer is a thin layer of electrodeposited essentially pure zinc which may be plated in a zinc bath commercially available from MacDermid, Inc., Waterbury, Conn. under the trade name "Kenlevel II". The thickness of the zinc galvanic layer may generally range from about 0.003–0.00010 inches, or even down to but preferably greater than 0.00005 inches. To minimize any white corrosion product of the zinc during service of the fasteners, the preferred thickness is under 0.0002 inches.

As final, outer coatings directly over the zinc layer, there may be applied in a first embodiment a conversion coating of a chromate or the like or, alternatively, in a second embodiment, sequential layers of copper, nickel and chromium or a chromium substitute. In the first embodiment, the conversion coating of a black chromate or the like is to provide additional corrosion protection and for aesthetic reasons. Conventional formulations of chromate coatings and conventional application techniques may be employed, with a substantially continuous plating layer and coating being applied. The thickness of the plating and/or coating layer is not limited and can be varied to obtain the desired level of protection.

The result of this embodiment is a fastener having applied thereon, in order, the following layers: 1) electroplated nickel or nickel alloy (preferably microthrowing nickel alloy) , 2) electroplated zinc-nickel alloy, 3) electroplated zinc and 4) chromate conversion film. The use of the final chromate or zinc/chromate layers is particularly useful as an improved substitute for topcoats of paint in that coated parts which must move relative to each other, for example, combination bolts or screws and washers, have less tendency to stick together because there is no need to cure the parts thoroughly as with paint. This provides better performance in installation and service.

In the more preferred embodiment where the zinc layer provides the base for the layers of copper, nickel and chromium or a chromium substitute, the copper and nickel layers are preferably electroplated in sequence, directly onto the previous layer, each layer having a thickness ranging between about 0.00001 and 0.0010 inches. Preferably, the copper layer has a minimum thickness of 0.00030 inches and the nickel layer has a minimum thickness of 0.00020 inches. As a final, top layer, chromium or metallic chromium substitute is applied in a layer directly to and over the layer of nickel. This final layer preferably has a thickness of 0.00001 to 0.00005 inches, and is commonly known in the industry as a flash layer. The chromium substitutes which may be utilized in accordance with this invention include, but are not limited to, the ternary alloys disclosed in U.S. Pat. No. Re 29,239, the disclosure of which is hereby incorporated by reference. These metals and alloys can be utilized to provide performance qualities and appearance which may be substituted for chromium. Preferred metallic chromium substitutes are ternary alloys of tin, cobalt and a third metal which may be either antimony, zinc or a metal of Periodic Table Group IIIA or VIB. Other known substitutes for metallic chromium plating may be utilized, such as a binary alloy comprising cobalt or tin.

The result of this embodiment is a fastener having preferably applied thereon, in order, the following layers in the minimum thicknesses listed: 1) electroplated nickel or nickel alloy (preferably microthrowing nickel alloy), 0.00015 in.; 2) electroplated zinc-nickel alloy, 0.00030 in.; 3) electroplated zinc, 0.00005 in.; 4) electroplated copper, 0.00030 in.; 5) electroplated bright nickel, 0.00020 in.; and 6) electroplated chromium, flash.

It has been discovered that the more preferred embodiment utilizing the combination zinc-nickel and zinc intermediate layers and the copper, nickel, and chromium top layers unexpectedly provides improved performance in standard corrosion tests as compared to the prior art coatings utilizing cadmium as an intermediate layer with the copper, nickel, and chromium top layers. The latter is exemplified by U.S. Pat. No. 4,188,459.

EXAMPLES

Example 1

One (1) load of a self tapping drill screw fastener, GM part no. 200073000, was plated to prior art specifications. Two (2) loads of the same type GM fasteners and one (1) load of a Ford threaded machine screw fastener, part no. N-806345, were plated to the minimum thicknesses described for the more preferred embodiment of the invention. Thickness of the plating layers were determined by cross-sectional metallographic inspection as shown in Table 1.

TABLE 1

| | Thickness (in.) | | | |
|---|---|---|---|---|
| | Prior Art | Present Invention | | |
| Load No. | 1 | 2 | 3 | 4 |
| Part | GM | GM | GM | Ford |
| Microthrow Nickel | .00020 | .00022 | .00020 | .00017 |
| Cadmium | .00051 | — | — | — |
| 5-7% Ni/bal. Zn | — | .00030 | .00035 | .00046 |
| Zinc | — | .00005 | .00007 | .00010 |
| Copper | .00046 | .00028 | .00035 | .00033 |
| Nickel | .00025 | .00022 | .00025 | .00036 |
| Chrome | flash | flash | flash | flash |

Figure 2:
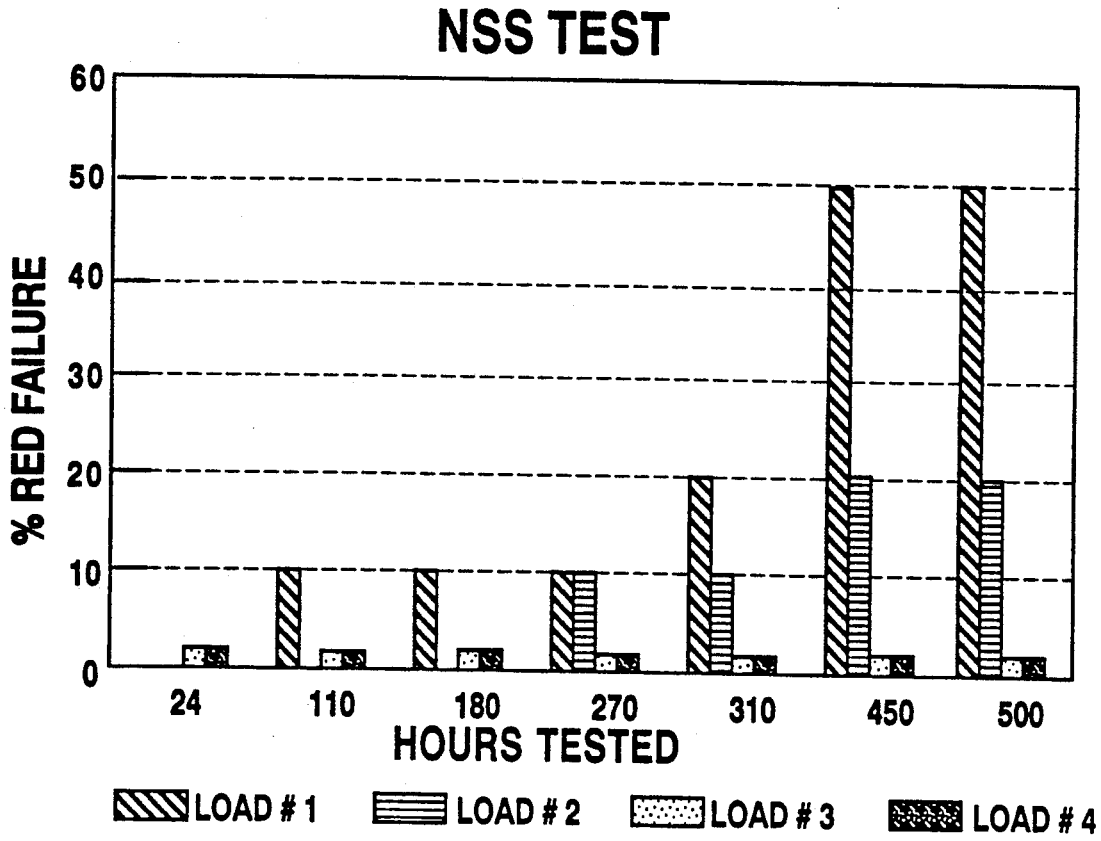

Ten (10) pieces from each load were corrosion tested in copper acetic salt spray (CASS) pursuant to GM specification GM4476P and in neutral salt spray (NSS) pursuant to GM specification GM4298P. The test results are shown in FIGS. 1 and 2, respectively. In the CASS test (FIG. 1), no part in any of the loads failed, i.e., no part indicated any sign of red rust visible to the eye (without magnification). In the NSS test (FIG. 2), the samples from loads nos. 1 and 2 were drilled through a steel sheet to simulate a body panel and tested. The samples from load nos. 3 and 4 were the undrilled fasteners themselves. In this test, the parts from load no. 1, the prior art, had a higher incidence of red failure, i.e. red rust visible to the naked eye. These results demonstrate that the coating of the invention provides corrosion protection at least as good as, and in some cases better, than the prior art coating utilizing cadmium as an intermediate plating layer.

Example 2

One (1) load of fasteners, GM part no. 200073000, was plated to prior art specifications. Three (3) loads of the same type GM fasteners were plated to the minimum thicknesses described for the more preferred embodiment of the invention. Thickness of the plating layers were determined by cross-sectional metallographic inspection as shown in Table 2.

TABLE 2

| | Thickness (in.) | | | |
|---|---|---|---|---|
| | Prior Art | Present Invention | | |
| Load No. | 5 | 6 | 7 | 8 |
| Part | GM | GM | GM | GM |
| Microthrow Nickel | .00019 | .00021 | .00025 | .00023 |
| Cadmium | .00041 | — | — | — |
| 5-7% Ni/bal. Zn | — | .00030 | .00037 | .00038 |
| Zinc | — | .00005 | .00008 | .00005 |
| Copper | .00030 | .00040 | .00036 | .00037 |
| Nickel | .00025 | .00021 | .00019 | .00019 |
| Chrome | flash | flash | flash | flash |

Figure 3:
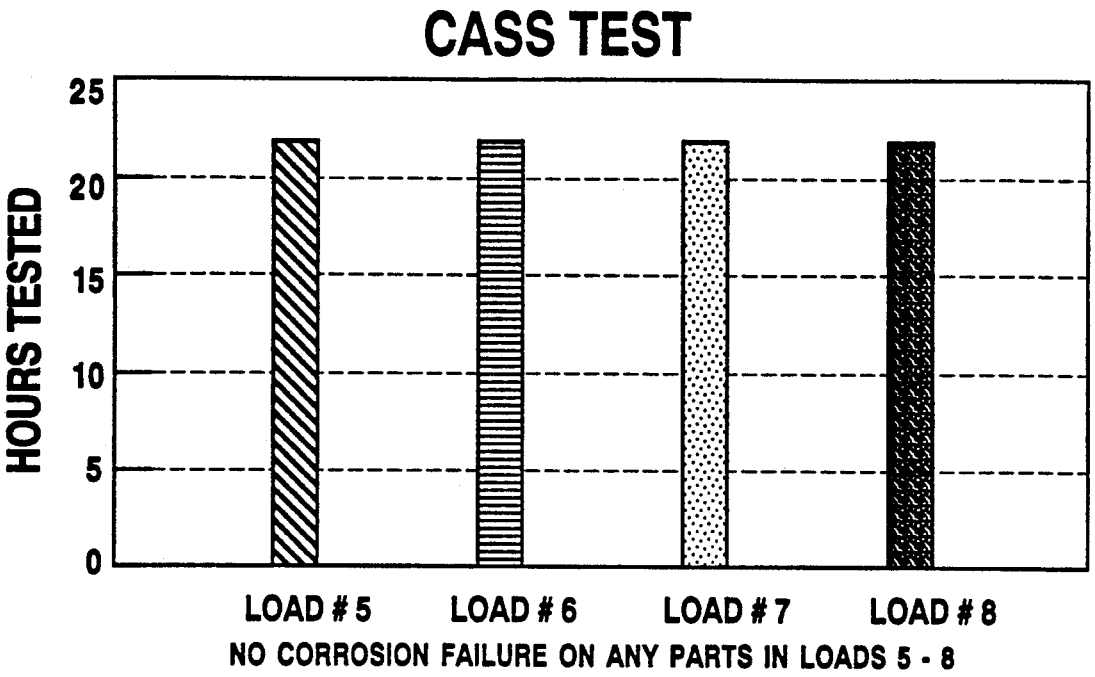
Figure 4:
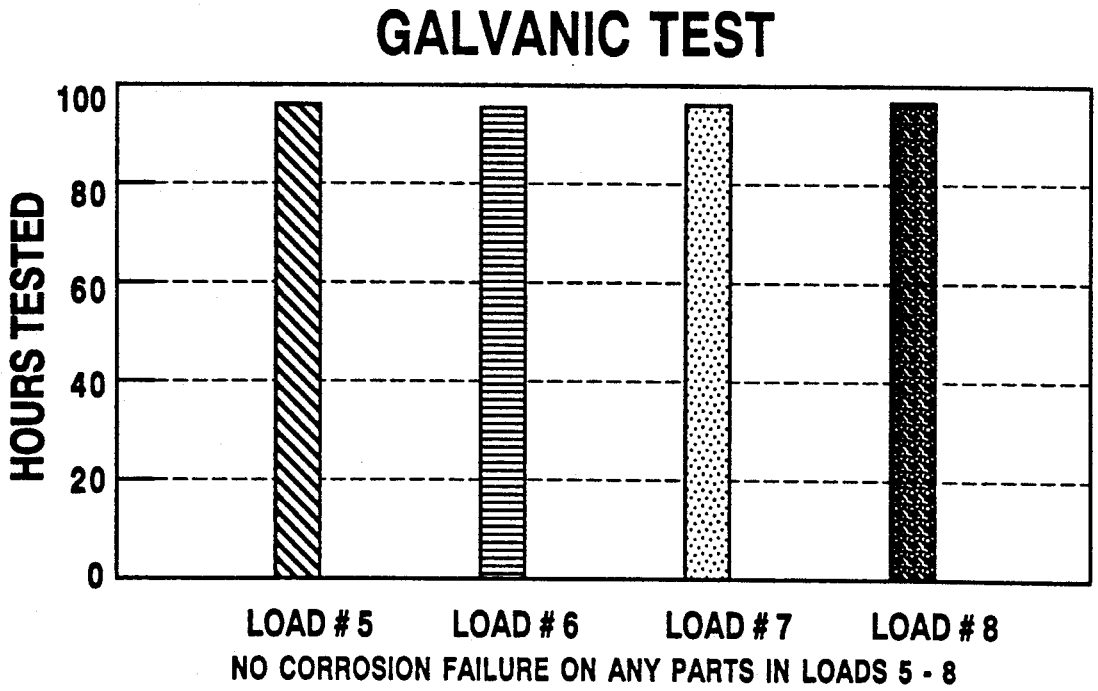

Ten (10) pieces from each load were corrosion tested in copper acetic salt spray (CASS) pursuant to GM specification GM4476P, and in galvanic tests in neutral salt spray. In the galvanic test, which is well known in industry, a strip of stainless steel is placed over a painted carbon steel sheet and the fasteners are drilled through both. The results are shown in FIGS. 3 and 4, respectively. In both the CASS test (FIG. 3) and the galvanic test (FIG. 4), no part in any of the loads failed, i.e., no part indicated visible red rust. These results demonstrate that the coating of the invention provides corrosion protection at least as good as the prior art coating utilizing cadmium as an intermediate layer.

In other tests, comparisons were made between fasteners having other types of coating layers and the more preferred embodiment of the present invention utilizing sequential layers of: 1) electroplated micro-throwing nickel, 2) electroplated zinc-nickel alloy, 3) electroplated zinc, 4) electroplated copper, 5) electroplated bright nickel, and 6) electroplated chromium. The other types of coatings tested were as follows:

A. 1) electroplated micro-throwing nickel, 2) electroplated zinc-nickel alloy, 3) electroplated copper, 4) electroplated bright nickel, and 5) electroplated chromium.

B. 1) electroplated micro-throwing nickel, 2) electroplated zinc, 3) electroplated copper, 4) electroplated bright nickel, and 5) electroplated chromium.

C. 1) electroplated micro-throwing nickel, 2) electroplated zinc-nickel alloy, 3) electroplated brass, 4) electroplated bright nickel, and 5) electroplated chromium.

D. 1) electroplated micro-throwing nickel, 2) electroplated zinc-nickel alloy, 3) electroplated bronze, 4) electroplated bright nickel, and 5) electroplated chromium.

E. 1) electroplated micro-throwing nickel, 2) electroplated zinc-nickel alloy, 3) electroplated brass, 4) electroplated copper, 5) electroplated bright nickel, and 6) electroplated chromium.

F. 1) electroplated micro-throwing nickel, 2) electroplated zinc-nickel alloy, 3) electroplated brass, 4) electroplated satin nickel, 5) electroplated bright nickel, and 6) electroplated chromium.

None of these alternate coatings A–F, which utilized layer thicknesses comparable to the prior art, consistently passed the CASS and NSS tests. All exhibited some type of peeling of the top plating layers. Thus, the present invention has been found to meet the objects presented above, in particular, providing superior corrosion resistant to ferrous metal substrates such as fasteners which are used in relatively severe corrosive environments such as those found in the automobile, without the use of cadmium. Cost savings are also expected in manufacturing by the substitution of the zinc-nickel and zinc layers for the cadmium layer.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A process for providing corrosion resistance to a ferrous metal fastener comprising the steps of:

a) applying a first layer of non-strike nickel or a nickel based alloy of at least 0.00005 in. thickness over said metal fastener;

b) applying over said first layer a second layer of a zinc based alloy having a major amount, by weight, of zinc and alloyed with nickel, cobalt, iron or combinations thereof;

c) applying over said second layer a third layer of zinc;

d) applying over said third layer a fourth layer of cooper;

e) applying over said fourth layer a fifth layer of nickel; and f) applying over said fifth layer a sixth layer of chromium or metallic chromium substitute selected from the group consisting of a binary alloy comprising cobalt or tin, and ternary alloys of tin, cobalt and a third metal selected from the group consisting of antimony, zinc and a metal of Periodic Table Group IIIA or VIB.

2. The process of claim 1 wherein said layers in steps (a)–(f) are applied by electroplating.

3. The process of claim 2 wherein said nickel or nickel based alloy first layer (a) comprises a micro-throwing nickel-zinc alloy.

4. The process of claim 1 wherein said first layer (a) is nickel of greater than 0.0001 in. thickness.

5. The process of claim 1 wherein said first layer (a) is a nickel based alloy of greater than 0.0001 in thickness.

6. The process of claim 1 wherein said second layer (b) is a zinc based alloy containing from about 5 to 15 weight percent nickel and wherein said third layer (c) is essentially pure zinc.

7. The process of claim 1 wherein said second layer (b) is a zinc based alloy containing from about 5 to 15 weight percent nickel applied to a thickness of about 0.00020–0.00060 in. and wherein said third layer (c) is essentially pure zinc applied to a thickness of about 0.00005–0.0002 in.

8. The process of claim 7 wherein said copper layer is applied to a thickness of at least 0.0003 in., said nickel layer is applied to a thickness of at least 0.0002 in., and said chromium or chromium substitute is applied to a thickness of at least 0.00001 in. as a flash coating.

9. A process for providing corrosion resistance to a ferrous metal fastener comprising the steps of:

a) electroplating a first layer of a non-strike micro-throwing nickel based alloy of at least 0.00005 in. thickness over said fastener;

b) applying over said first layer a second layer of a zinc based alloy having a major amount, by weight, of zinc and alloyed with nickel, cobalt, iron or combinations thereof;

c) electroplating a third layer of essentially pure zinc at a thickness of about 0.00005–0.0002 in. over said second layer;

d) electroplating a fourth layer of copper at a thickness of at least 0.0003 in. over said third layer;

e) electroplating a fifth layer of nickel at a thickness of at least 0.0002 in. over said fourth layer; and f) electroplating a sixth layer of chromium or metallic chromium substitute at a thickness of at least 0.00001 in. over said fifth layer, said metallic chromium substitute being selected from the group consisting of a binary alloy comprising cobalt or tin, and ternary alloys of tin, cobalt and a third metal selected from the group consisting of antimony, zinc and a metal of Periodic Table Group IIIA or VIB.

10. The process of claim 9 wherein said micro-throwing nickel based alloy first layer includes zinc in an amount less than one (1) weight percent.

11. The process of claim 10 wherein said second layer (b) is a zinc based alloy containing from about 5 to 10 weight percent nickel.

12. The process of claim 9 wherein said fastener comprises a bolt or drill screw in combination with a washer.

13. A corrosion resistant fastener having a ferrous metal substrate and, in sequence, the following layers over said substrate:

a) a first layer of a non-strike nickel or nickel based alloy of at least 0.00005 in. thickness;

b) a second layer of a zinc based alloy containing a major amount, by weight, of zinc and alloyed with nickel, cobalt, iron or combinations thereof;

c) a third layer of zinc;

d) a fourth layer of copper;

e) a fifth layer of nickel; and f) a sixth layer of chromium or metallic chromium substitute, said metallic chromium substitute being selected from the group consisting of a binary alloy comprising cobalt or tin, and ternary alloys of tin, cobalt and a third metal selected from the group consisting of antimony, zinc and a metal of Periodic Table Group IIIA or VIB.

14. The fastener of claim 13 wherein said nickel or nickel based alloy first layer (a) comprises a micro-throwing nickel-zinc alloy which includes zinc in an amount less than three (3) weight percent.

15. The fastener of claim 13 wherein said metal fastener comprises a bolt or drill screw in combination with a washer.

16. The fastener of claim 13 wherein said second layer is a zinc based alloy containing from about 5 to 15 weight percent nickel.

17. The fastener of claim 13 wherein said second layer is a zinc based alloy containing from about 5 to 15 weight percent nickel having a thickness of about 0.00020–0.00060 in. and wherein said third layer (c) is essentially pure zinc having a thickness of about 0.00005–0.0002 in.

18. The fastener of claim 17 wherein said copper layer has a thickness of at least 0.0003 in., said nickel layer has a thickness of at least 0.0002 in., and said chromium or chromium substitute has a thickness of at least 0.00001 in.

* * * * *

UNITED STATES PATENT AND TRADEMARK OFFICE

CERTIFICATE OF CORRECTION

PATENT NO. : 5,275,892

DATED : January 4, 1994

INVENTOR(S) : Hyner et al.

It is certified that error appears in the above-indentified patent and that said Letters Patent is hereby corrected as shown below:

Column 7, Claim 1, Line 12, "cooper" should read - - copper - -.

Signed and Sealed this

Tenth Day of May, 1994

*Attest:*

Bruce Lehman

BRUCE LEHMAN

*Attesting Officer*

*Commissioner of Patents and Trademarks*